US009181742B2

(12) United States Patent
Cirilli

(10) Patent No.: US 9,181,742 B2
(45) Date of Patent: Nov. 10, 2015

(54) ARTICULATED SHUTTER HOLDER

(75) Inventor: Alessandro Cirilli, Jesi (IT)

(73) Assignee: I.QUATTRO S.R.L., San Marcello (AN) (IT)

( * ) Notice: Subject to any disclaimer, the term of this patent is extended or adjusted under 35 U.S.C. 154(b) by 252 days.

(21) Appl. No.: 13/876,715

(22) PCT Filed: Oct. 10, 2011

(86) PCT No.: PCT/EP2011/067653

§ 371 (c)(1), (2), (4) Date: Mar. 28, 2013

(87) PCT Pub. No.: WO2012/049125

PCT Pub. Date: Apr. 19, 2012

(65) Prior Publication Data

US 2013/0192027 A1 Aug. 1, 2013

(30) Foreign Application Priority Data

Oct. 11, 2010 (IT) ..... AN2010A0175

(51) Int. Cl.

*E05D 15/28* (2006.01)
*E05D 11/10* (2006.01)
*E05C 17/00* (2006.01)
*E05C 17/24* (2006.01)

(52) U.S. Cl.

CPC ..... *E05D 11/1007* (2013.01); *E05C 17/025* (2013.01); *E05C 17/24* (2013.01); *E05D 11/1014* (2013.01); *Y10T 16/54095* (2015.01)

(58) Field of Classification Search

CPC ..... E05D 11/1007; E05D 11/1014; E05C 17/025; E05C 7/24; Y10T 16/54095

USPC ..... 49/246, 247, 248, 249; 16/368, 369, 16/370

See application file for complete search history.

(56) References Cited

U.S. PATENT DOCUMENTS

| | | | | |
|---|---|---|---|---|
| 4,833,754 | A * | 5/1989 | Yang | 16/339 |
| 5,491,930 | A * | 2/1996 | La See | 49/252 |
| 7,900,322 | B2 * | 3/2011 | Doring et al. | 16/362 |
| 7,900,400 | B2 * | 3/2011 | Liang et al. | 49/246 |
| 8,505,240 | B2 * | 8/2013 | Nguyen et al. | 49/252 |
| 2005/0284025 | A1 * | 12/2005 | Balbo Di Vinadio | 49/246 |

* cited by examiner

*Primary Examiner* — Jerry Redman
(74) *Attorney, Agent, or Firm* — Egbert Law Offices, PLLC

(57) ABSTRACT

An articulated device is adapted to hold a shutter in different open positions, without the need for the user to lean out of the window.

11 Claims, 8 Drawing Sheets

ARTICULATED SHUTTER HOLDER

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present patent application for industrial invention relates to an articulated shutter holder.

The device of the invention has been devised in order to solve a common problem, which consists in holding shutters provided in windows and French windows firmly in open position.

2. Description of Related Art Including Information Disclosed Under 37 CFR 1.97 and 1.98.

As it is known, the need of holding shutters in open position is due to the fact that, without such a device, shutters would tend to close uncontrollably and bang, rotating around hinges, under the action of strong wind.

In order to meet such a need, shutters can be normally fixed in completely open position by means of traditional hooks fixed on the external wall of the building, at the sides of the window.

Of course, such a stop can be provided when the shutter has completed its opening rotation, by an angle of approximately 180°, until it rests against the external wall of the building.

In spite of being largely popular, such a solution is impaired by severe drawbacks.

Firstly, the user may often suffer difficulties and discomfort—also in relation with height and general physical conditions—when said shutter holder must be actuated manually.

In fact, the user must lean out of the window in order to reach the hook mounted on the external wall of the building with his hand.

Moreover, it must be noted that such shutter holder hooks are also available in a version adapted to automatically hook the shutter when interference with lower edge is produced.

In such a case, it is easier for the user to stop the shutter, it only being necessary to push said shutter to the end of the opening travel, until it interferes with the "automatic stop" hook.

However, in order to release the shutter from such an automatic hook, the user must intervene manually, leaning out of the window.

Another drawback of such a traditional technology can be found in the difficulties and discomfort related with the installation of said shutter holder hooks on the external wall of the buildings, especially when such an operation must be carried out in windows on high floors.

BRIEF SUMMARY OF THE INVENTION

The specific purpose of the present invention is to introduce a new solution to hold shutters, which is actually capable of overcoming the aforementioned drawbacks.

Such a new technology, in fact, entrusts the task of holding shutters in maximum open position to a device provided with a knee-articulated lever mechanism, adapted to be mounted in intermediate position between the cross-piece of the shutter and the cross-piece of the frame fixed on the window masonry.

Until the shutter is maintained in closed position, said lever mechanism is in completely invisible intermediate position between the cross-piece of the shutter and the cross-piece of the frame.

However, when the shutter is rotated to open, being coupled with it, said lever mechanism tends to make a similar contemporary rotation with respect to the pivoting point in correspondence of said cross-piece of the frame.

When the shutter has reached the end of the opening travel, the lever mechanism is brought in external position on the frame, "astride" the upright of the frame and the upright of the shutter hinged on it.

Moreover, it must be noted that said lever mechanism is adapted to cooperate with a vertical latch provided on the shutter, in correspondence of said upright in the proximity of the hinges.

The function of the latch is to be inserted, from below upwards, into a circular hole obtained on said lever mechanism, when the latter is in the position that corresponds to complete opening of the shutter.

In view of the above, a sliding movement of the latch—which can be easily carried out by the user without assuming dangerous positions or making severe efforts—can stop the lever mechanism and consequently the rotation of the shutter in said maximum opening position.

The aforementioned general description has disclosed the advantageous characteristics of the device of the invention, which are basically related with the fact that said device can be mounted by the installer and actuated by the user without reaching the external part of the window.

BRIEF DESCRIPTION OF SEVERAL VIEW OF THE DRAWINGS

For explanatory reasons, the description of the invention continues with reference to the attached drawings, which only have an illustrative, not limiting value, wherein.

DETAILED DESCRIPTION OF THE INVENTION

Referring to the aforementioned figures, first of all it must be noted that the device of the invention is designed to be mounted between a traditional shutter door (IM) and relevant frame (T) drowned in the window masonry, both being made of traditional metal sections.

Figure 1:
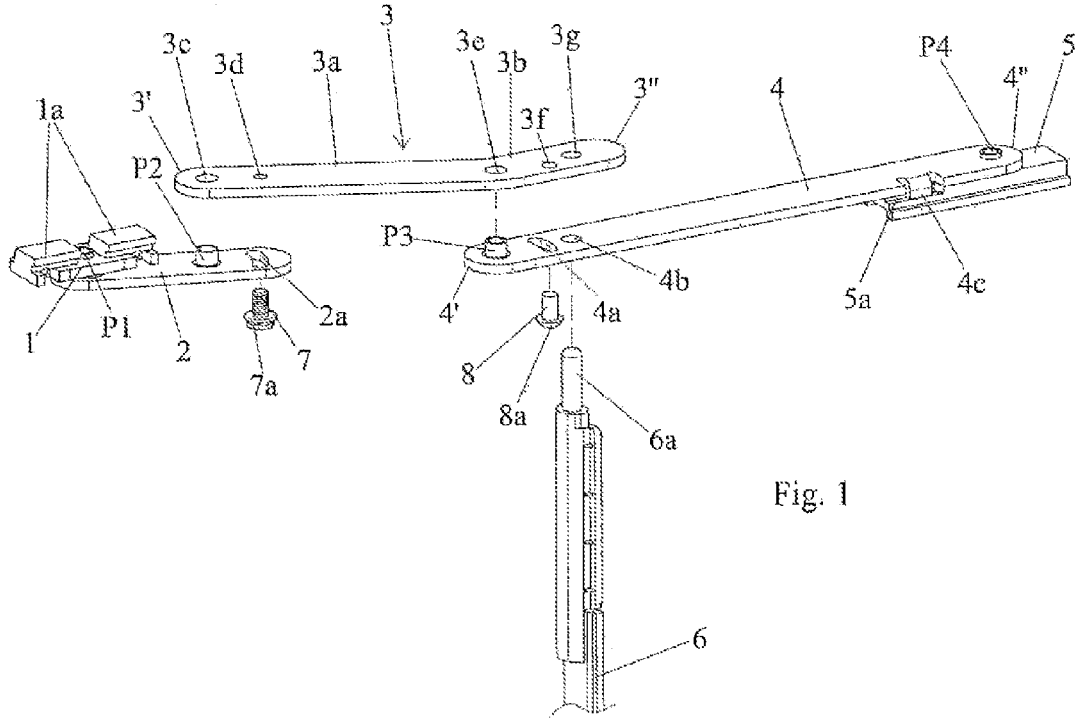
FIG. 1 is an axonometric exploded view of the device of the invention.
Figure 2:
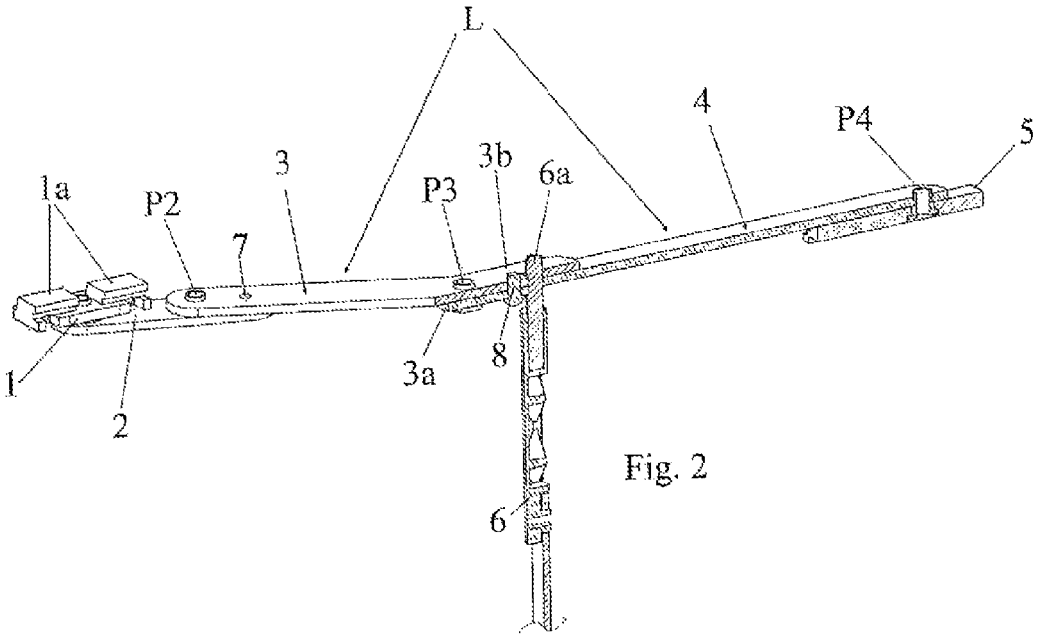
FIG. 2 is a partially sectioned axonometric view of the device of FIG. 1, with parts in mutual cooperation position.
Figure 3:
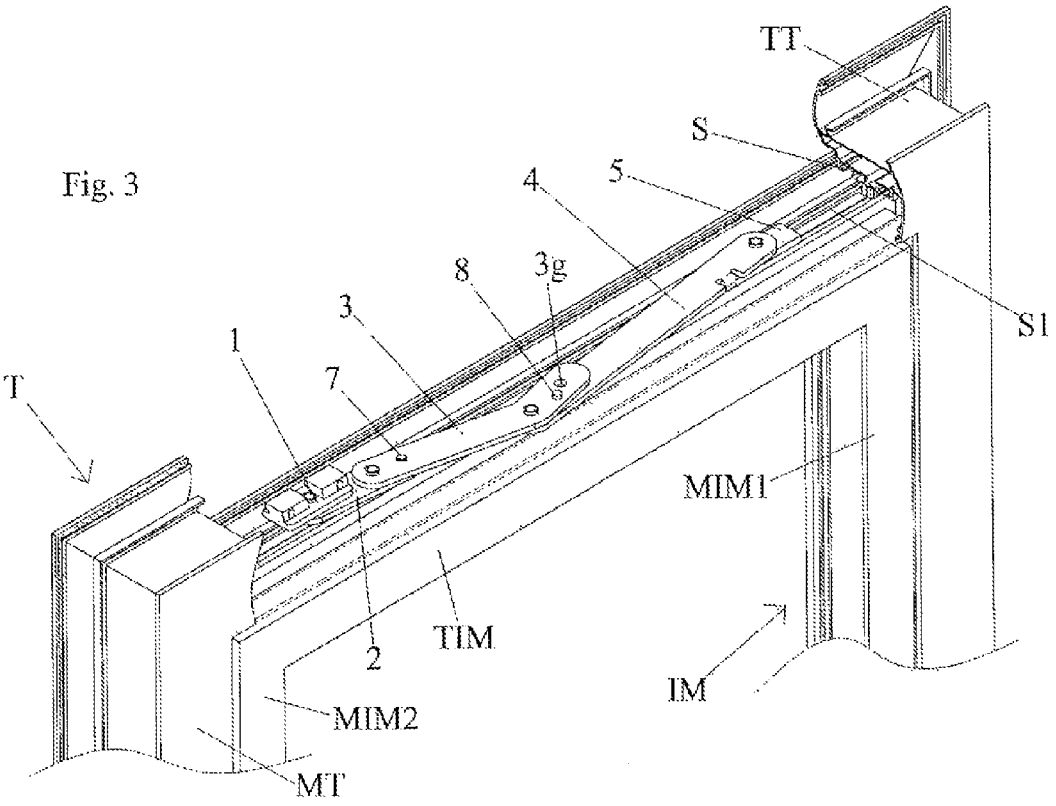
FIG. 3 is an axonometric view of the device of the invention when the shutter—seen from the inside of the building—is in closed position.

Especially referring to FIGS. 1 and 3, it must be also noted that the device of the invention is provided with a knee-articulated lever mechanism (L), composed of the following five parts:

- a first plate (1) provided in upper position with a pair of shaped sections (1*a*) adapted to be engaged and attached into the traditional longitudinal groove (S) defined by a parallel pair of stiffening ribs (C) on the lower side of the cross-piece of the frame (T).
- a horizontal wing (2) obtained with a metal plate, which is pivoted, in correspondence of the back end, under said plate (1), by means of a first pin with vertical axis (P1); it being provided that said wing (2) is also provided, towards the front end, with a second upward-protruding pin (P2), and with a half moon-shaped slot (2*a*) with concavity facing said second pin (P2);
- a first arm (3), obtained with a metal plate, comprising a long rectilinear section (3*a*) frontally joined with a shorter section (3*b*) tilted with respect to the preceding one, it being provided that said arm (3) is provided with five circular holes, of which the first one (3*c*) is positioned in correspondence of the back end (3'), the second one (3*d*) is threaded and situated in slightly more internal position with respect to the first one, the third one (3*e*) is basically at the height of the point of origin of said tilted section (3*b*), the fourth one (3*f*) at approximately half of the length of said tilted section (3*b*) and the fifth one (3*g*) in correspondence of the front end (3") of said first arm (3);
- a perfectly rectilinear second arm (4), obtained with the same metal plate, which is provided, starting from the back end (4'), with a third upward-protruding pin (P3), a half moon-shaped slot (4*a*) with concavity towards said third pin (P3) and a circular hole (4*b*); it being also provided that said second arm (4) is provided, in correspondence of one of its longitudinal borders, with a projection (4*c*) that protrudes shortly downwards, beyond the thickness of said second arm (4);
- a second plate (5) pivoted under the front end (4") of said second arm (4) by means of a fourth pin with vertical axis (P4) and also provided with suitably shaped profile to be exactly engaged into the traditional longitudinal groove (S1) that is defined, in correspondence of the upper side of the cross-piece of said shutter (IM), by a parallel pair of stiffening ribs (C1); it being provided that said second plate (5) is provided, in correspondence of the back end, with a lowered longitudinal step (5*a*) facing the side that corresponds to the one where, on said second arm (4), said lateral projection (4*c*) is situated.

Figure 8:
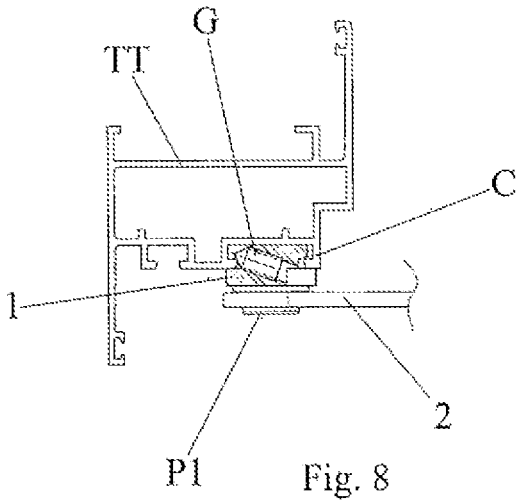
FIG. 8 is a section of FIG. 6 with plane A-A.
Figure 7:
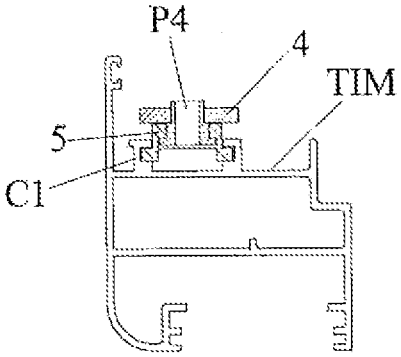
FIG. 7 is a section of FIG. 6 with plane B-B.

Moreover, said first plate (1) is firmly fixed inside the groove defined by said two ribs (C) of the cross-piece (TT) of the frame (T) by means of a locking pin (G) mounted in tilted position, as expressly shown in FIG. 8.

The knee lever mechanism (L) is adapted to cooperate with a latch (6)—mounted in vertical position on the outside of the upright (MIM2) of the shutter (IM) in the proximity of the hinges—which is an integral part of the new shutter holder of the invention.

As shown in FIG. 1:

- the back end (3') of said first arm (3) is adapted to rest above said wing (2)
- the distance between said second pin (P2) and slot (2*a*) in said wing (2) is exactly equal to the distance between said first hole (3*c*) and said second hole (3*d*) in said first arm (3)
- said second pin (P2) protruding upwards from said wing (2) exactly penetrates into said first hole (3*c*) of the first arm (3), before being suitably riveted;
- said slot (2*a*) of the wing (2) is exactly disposed under said hole (3*d*) of the arm (3), in such a way that the vertical stem of a fixing and adjustment screw (7) penetrates them, from below upwards, until the enlarged head (7*a*) is stopped against the lower side of the wing (2).

The function of said screw (7) is to couple, after adjusting the intersection angle, said wing (2) and arm (3) according to the geometrical characteristics of the profile of the cross-piece (TT) of the frame (T) and the cross-piece (TIM) of the shutter (IM).

An analysis of FIG. 1 also shows that:

- the front tilted section (3*b*) of said first arm (3) is adapted to rest above the back end (4') of said second arm (4)
- the distance and mutual position provided, within said tilted section (3*b*) of the first arm (3), between said third hole (3*e*), fourth hole (3*f*) and fifth hole (3*g*) correspond to the ones provided, within said back end (4') of said second arm (4), between said third pin (P3), half moon-shaped slot (4*a*) and hole (4*b*)
- said third pin (P3) protruding upwards from said second arm (4) exactly penetrates into said third hole (3*e*) situated at the origin of the tilted section (3*b*) of the first arm (3), before being suitably riveted;
- said slot (4*a*) of the second arm (4) is exactly disposed under said fifth hole (3*f*) of the tilted section (3*b*) of the first arm (3), so that the vertical stem of the rivet (8) penetrates them, from below upwards, until the enlarged head (8*a*) is stopped against the lower side of the second arm (4), leaving it free to slide inside the slot (4*a*);
- the fifth hole (3*g*) of the first arm (3) is exactly overlapped with the hole (4*b*) of the second arm (4).

The operating principle of the device of the invention is as follows, with reference to FIG. 3.

FIG. 3 shows a shutter (IM) in closed position, when it is exactly contained into the frame (T) fixed to the masonry of the window; moreover, it must be noted that in such a case the shutter (IM) and its frame (T) are seen from the inside of the building.

The specific purpose of FIG. 3 is to show the position of the shutter holder according to the invention when the shutter (IM) is closed; for convenience purposes, the upper cross-piece (TT) has been partially removed from the frame (T).

Given the fact that its parts can rotate mutually around said pivoting pins (P1, P3, P4), said lever mechanism (L) can be in "extended" position, wherein said parts are basically aligned inside the horizontal space comprised between the cross-piece (TT) of the frame (T) and the cross-piece (TIM) of the shutter (IM).

The position of said first plate (1) and second plate (5) is particularly interesting, since they represent the two ends of the lever mechanism (L) provided in the device of the invention.

Actually, the two plates (1, 5) are in perfectly aligned position in said horizontal space between said two cross-pieces (TT, TIM), although at two different heights.

As a matter of fact, the first plate (1) is exactly engaged and firmly fixed inside a longitudinal groove (S) normally provided on the lower side of the cross-piece (TT) of said frame (T), whereas the second plate (5) is exactly engaged, freely slidingly, inside a similar longitudinal groove (S1) normally provided on the upper side of the cross-piece (TIM) of the shutter (IM).

Moreover, it must be noted that the fixing point of said first plate (1) along the cross-piece (TT) of the frame (T) is situated in the proximity of the upright (MT) to which the shutter (IM) is hinged, whereas the point where the second plate (5) is situated along the cross-piece (TIM) of the shutter (IM) is in the proximity of the upright (MIM1) of the latter, opposite the upright (MIM2) hinged to the frame (T).

Such an aligned, yet considerably spaced, position of the two plates (1, 5) corresponds to said basically aligned position of the parts of the lever mechanism (L) provided in the device of the invention.

An analysis of FIG. 3 shows that:

said wing (2) is faced towards said second plate (5) and disposed with longitudinal axis in basically parallel position with respect to longitudinal axis of said first plate (1)

said first arm (3) is disposed with longitudinal axis of the rectilinear section (3*a*) in basically parallel position with respect to longitudinal axis of said wing (2)

said second arm (4) is disposed, with respect to rectilinear section (3*a*) of said first arm (3), in such a way to form a substantially straight angle with it, with vertex facing towards the inside of the window, in a condition in which the longitudinal axis of said tilted section (3*b*) of the first arm (3) is disposed in intersection condition, although by a reduced angle, with respect to the longitudinal axis of said second arm (4)

simultaneously, said second arm (4) is disposed with longitudinal axis in intersection position with longitudinal axis of said second plate (5).

Figure 4:
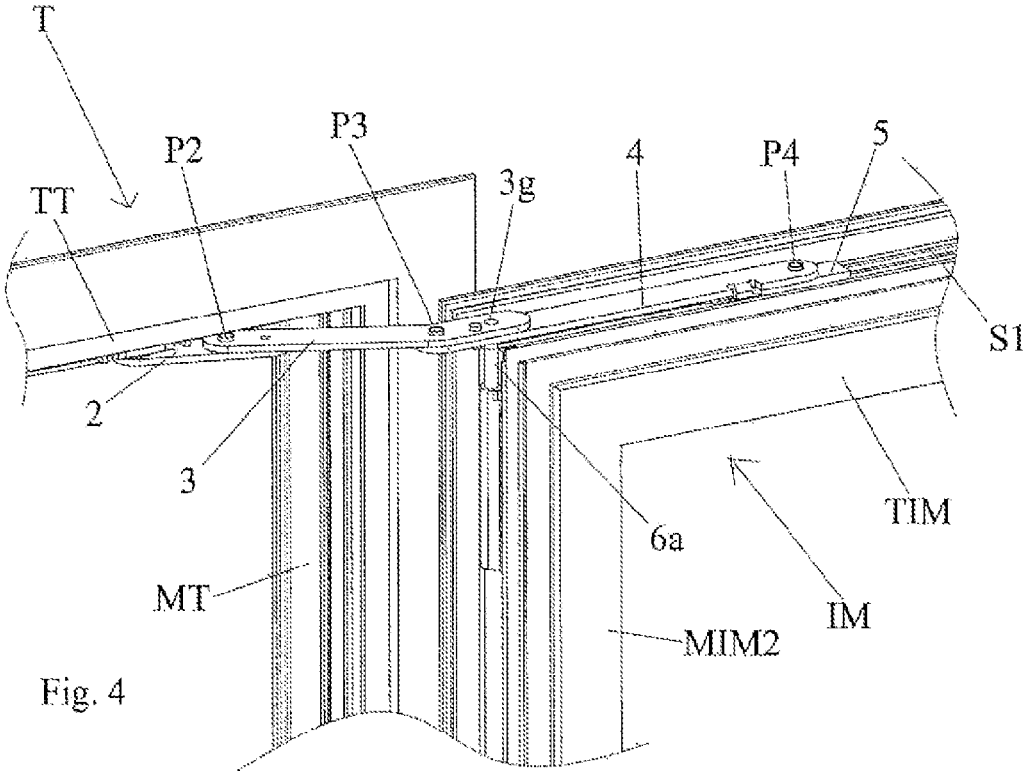
FIG. 4 is an axonometric view of the device of the invention when the shutter—seen from the outside of the building—is in maximum open position.

FIG. 4 shows the position of the lever mechanism (L) provided in the shutter holder of the invention when the shutter (IM), shown in this case from the outside of the window, is brought to maximum open position further to 180° rotation around said upright (MT) of the frame (T).

Such a rotation of the shutter (IM) imposes the following movement to the lever mechanism (L):

said wing (2) rotates by approximately 180° with respect to said first plate (1), in such a way to be directed towards the upright (MT) of the frame (T) where the shutter (IM) is hinged the first arm (3) protrudes from the cross-piece (TT) of the frame (T) and is disposed with longitudinal axis in slight intersection position with respect to longitudinal axis of said wing (2), in such a condition that the rectilinear section (3*a*) is directed towards said upright (MT) of the frame (T) and the tilted section (3*b*) is basically parallel to said cross-piece (TT) on the front of the upright (MT).

the second arm (4) is perfectly aligned with said tilted section (3*b*) of said first arm (3)

the second plate (5), coupled with said second arm (4), is moved back along the groove (S1) on top of the cross-piece (TIM) of the shutter (IM), thus getting closer to the upright (MIM2) in correspondence of which the shutter (IM) is hinged to the frame (T)

the fifth hole (3*g*) of the first arm (3) and the hole (4*b*) of the second arm (4) are brought in perfectly aligned position, being exactly disposed on the vertical line of the point (6*a*) of the latch (6) applied on the outside of the hinging upright (MIM2) of the shutter (IM).

Figure 5:
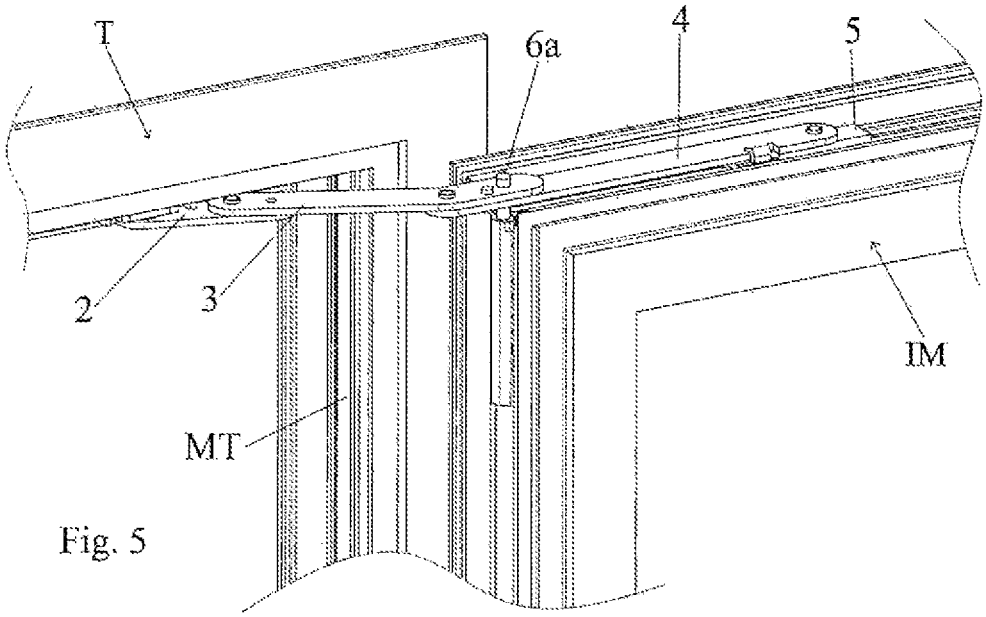
FIG. 5 is the same as the preceding figure, except for the fact that it shows the position of the latch in order to stop the shutter.

Such a condition allows the user to hold the shutter in maximum open position only by enabling the upward sliding of the point (6*a*) of the latch (6), in such a way that the same exactly penetrates, from below upwards, the two aligned overlapped holes (3*g*, 4*b*), as expressly shown in FIG. 5.

In fact, the insertion of such a point (6*a*) prevents any additional mutual rotation of the two arms (3, 4) and consequently any additional movement of the kinematic chain to which they belong.

In such a way, the shutter (IM) can firmly maintain the open position, in spite of opposite stress caused by strong winds.

Only by lowering the latch (6), in fact, it would be possible to restore freedom of movement to the kinematic chain, making it possible to close the shutter (IM) again.

In view of the above, it is easy to understand the reason why the first arm (3) is provided with front tilted section (3*b*).

Considering that the first arm (3) suffers the interference of said upright (MT) of the frame (T) at the end of external rotation, it is evident that only the inclination given to the front section (3*b*) allows the second arm (4), and more precisely the entire shutter (IM) coupled with it, to reach a correct position close and parallel to the external wall of the building.

As shown in the enclosed figures, two devices are provided in the shutter holder of the invention to guarantee that the two holes (3*g*, 4*b*) of the arms (3, 4), adapted to be simultaneously penetrated by the point (6*a*) of the latch (6), "automatically" reach said perfectly aligned position when the shutter (IM) is at the end of the opening travel.

The first device consists in the presence of said rivet (8), which is responsible for avoiding that the rotation of the second arm (4) with respect to the first one (3) is excessive and consequently capable of losing said aligned condition between the holes (3*g*, 4*b*).

To that end, the stem of said rivet (8) must be inserted, from below upwards, into said half moon shaped slot (4*a*) of the second arm (4) and exactly inserted (and locked) inside said fourth hole (3*f*) of the first arm (3), as shown in FIG. 1.

Also the installation of said rivet (8) must be considered as completed when the enlarged head (8*a*) of the same is stopped, in external position on the slot (4*a*), against the lower side of said second arm (4).

In such a condition, the stem of the rivet (8) is adapted to alternatively slide along the half moon shaped slot (4*a*) of the second arm (4), from one end to the other, according to the rotation direction given by said lever mechanism (L) provided in the device of the invention.

Moreover, when the stem of the rivet (8) reaches either end of the slot (4*a*), additional mutual rotation of the second arm (4) with respect to the first arm (3) is prevented.

Therefore, when the shutter (IM) is opened, the rivet (8) reaches the end of travel inside the slot (4*a*) when the two holes (3*g*, 4*b*) of the first (3) and second (4) arm are in perfectly vertically aligned position.

The second device provided with the same purpose consists in the fact that said lateral projection (4*c*) of the second arm (4) is stopped, during the complete opening of shutter (IM), against said step (5*a*) provided on the side of said second plate (5).

Such an interference prevents the second arm (4) from continuing rotation beyond said perfectly aligned position with said tilted section (3*b*) of the first arm (3), given the fact that, if such a condition occurred, the necessary alignment between the holes (3*g*, 4*c*) of the arms (3, 4) would be impaired.

Figure 6:
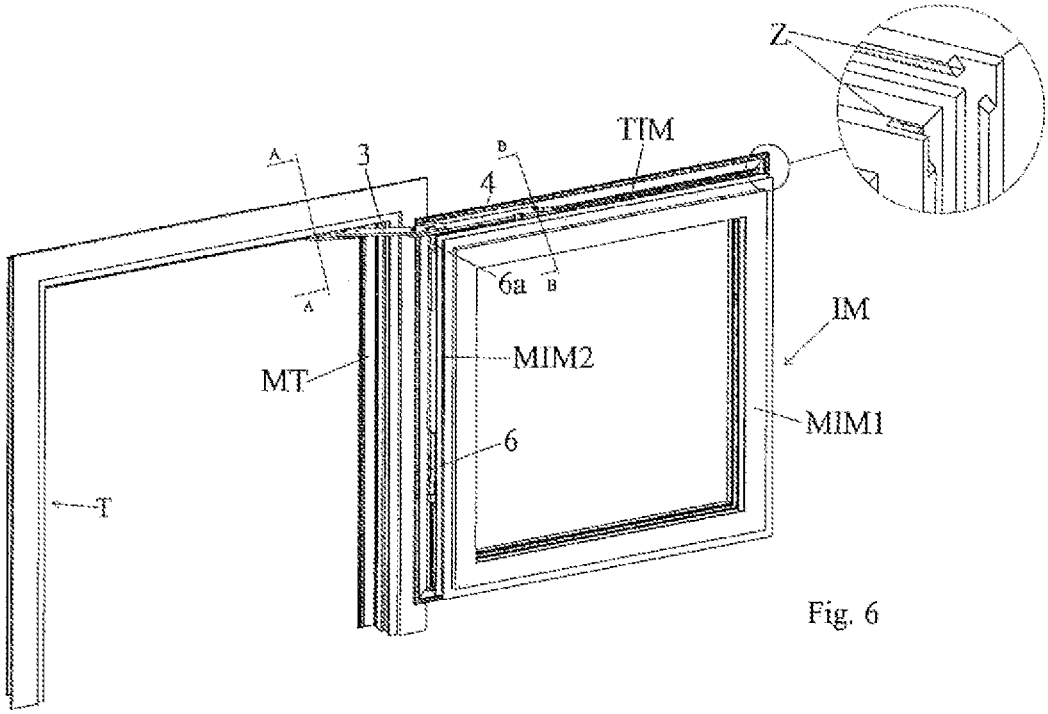
FIG. 6 is the same as FIG. 4, except for the fact that it shows the shutter and relevant frame completely, with a lower detail level.

Referring to the enlarged view of FIG. 6, it must be noted that the external corner of the cross-piece (TIM) of the shutter (IM) is provided, exactly in the connection with the upright (MIM1), with two roundings (Z) in correspondence of the traditional stiffening ribs provided in metal windows.

Said roundings (Z) has been provided to allow for insertion of second plate (5) into said housing groove (S1) provided in correspondence of upper side of cross-piece (TIM).

Regardless of the above, as expressly shown in the enclosed figures, it must be finally said that the present inventive idea can be advantageously used also on windows made of wood or PVC, in addition to metal windows.

It will be simply necessary to provide a suitable seat to insert and lock said first plate (1) in correspondence of the cross-piece of the frame of such a wooden or PVC window, as well as a housing and guide track for said second plate (5) in correspondence of the cross-piece of the shutter.

Figure 10:
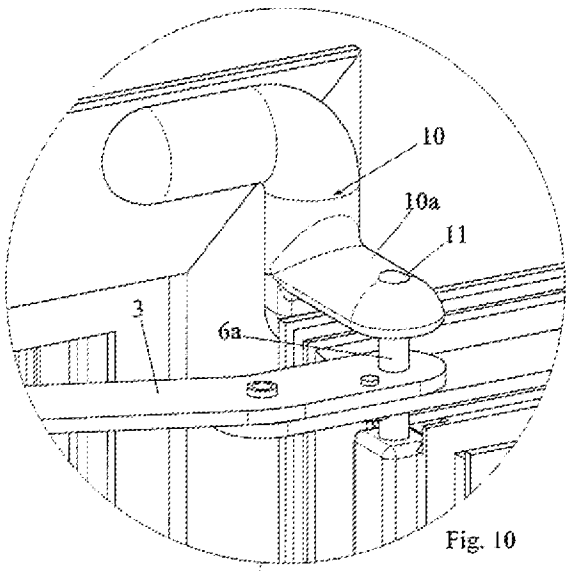
FIG. 10 is an enlarged view of a detail of FIG. 9.
Figure 9:
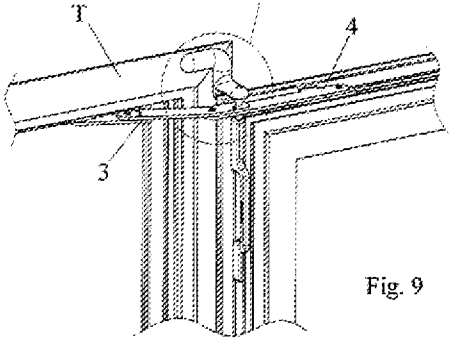
FIG. 9 is basically the same as FIG. 5, except for it refers to a different constructive embodiment of the device.

Referring to FIGS. 9 and 10, it must be noted that according to a preferred embodiment of the device, said device is also provided with a square (10) adapted to be fixed on the frame (T) and provided with shelf (10*a*) with end provided with hole (11) with vertical axis perfectly aligned with said latch (6), the point (6*a*) of which is exactly housed in said hole (11).

Said square (10) has been introduced in order to relieve the hinges of the window from the heavy stress suffered when the shutter (IM) is locked in open position.

In such a position, in fact, said shutter (IM) is especially subjected to the thrust of the wind, which is indirectly discharged on the hinges of the window.

In such a perspective, said square (10) actuates as additional connection means between shutter (IM) and frame (T), thus reducing the load on said hinges.

The invention claimed is:

1. An apparatus comprising:

an articulated shutter having a frame, said frame having a first cross-piece and a second cross-piece and an upright;

a lever mechanism comprising;

a first flat arm having a back end and a front end, said back end pivotally mounted by a first pin having a vertical axis at a fixed point of said first cross-piece, said first flat arm having a front tilted section and a circular hole at said front and of said first flat arm;

a second flat arm having a back end and a front end, said second flat arm being perfectly rectilinear, said second flat arm pivotable thereunder at a back end thereof by a second pin having a vertical axis positioned at a point of origin of said front tilted section of said first flat arm, said second flat arm having a circular hole aligned perfectly with said circular hole of said first flat arm, said second flat arm being perfectly aligned with said front tilted section of said first flat arm;

a plate slidingly inserted into a longitudinal groove formed above said second cross-piece of said shutter, said plate being pivotally mounted by a third pin having a vertical axis under said front end of said second flat arm; and a latch vertically mounted in an external position on said upright of said shutter, said upright having hinges affixed thereto, said latch having an upper point at an end thereof, said upper point positioned in said circular hole of said second arm and said circular hole of said first arm, said first and second flat arms being perfectly aligned when in a maximum opening position of said shutter.

2. The apparatus of claim 1, said back end of said first flat arm having a wing connected thereto that is pivotally mounted to said first pin, said back end of said first flat arm being positioned above said wing.

3. The apparatus of claim 2, said first pin extending downwardly from another plate, said another plate having upper profiles engaged with and fixed inside a longitudinal groove formed under said first cross-piece of said frame of said shutter.

4. The apparatus of claim 3, said another plate being fixed by a locking pin inside said longitudinal groove of said first cross-piece of said shutter.

5. The apparatus of claim 2, further comprising:

a means for fixing and adjusting said back end of said first flat arm and said wing.

6. The apparatus of claim 5, said means positioned between said back end of said first flat arm and said wing, said means comprising a pivoting pin having a vertical axis and a fixing and adjustment screw having a threaded stem extending up to a half-moon shaped slot formed at a front end of said wing and engaged into a threaded hole formed in said first flat arm, said half-moon shaped slot having a concavity facing said pivoting pin.

7. The apparatus of claim 6, said pivoting pin protruding upwardly from said wing and engaged in a hole formed in said back end of said first flat arm.

8. The apparatus of claim 1, said second pin protruding upwardly from said back end of said second flat arm and engaged with a hole formed at said point of origin of said front tilted section of said first flat arm.

9. The apparatus of claim 1, said first arm having an intermediate hole positioned between said hole at said point of origin of said front tilted section and said circular hole at said front end of said first flat arm, said intermediate hole positioned above a half-moon shaped slot formed in said second flat arm when said first and second flat arms are pivoted about said second pin, said half-moon shaped slot of said second flat arm receiving a cylindrical stem of a rivet, said rivet engaged in said intermediate hole of said first flat arm, said half-moon shaped slot having a concavity facing said second pin.

10. The apparatus of claim 1, said second flat arm having a projection that extends downwardly, said projection being adapted to stop against a longitudinal step of said another plate when a perfect alignment occurs between said circular hole at said front end of said first flat arm and said circular hole of said second flat arm.

11. The apparatus of claim 1, further comprising:

a square fixed on said frame, said square comprising a shelf, said shelf having a hole at one end thereof, said hole of said shelf having a vertical axis aligned with said latch, said latch having a point received in said hole of said shelf.

* * * * *